US009097147B2

(12) United States Patent
Tadokoro et al.

(10) Patent No.: US 9,097,147 B2
(45) Date of Patent: Aug. 4, 2015

(54) VALVE TIMING CONTROL SYSTEM FOR INTERNAL COMBUSTION ENGINE

(71) Applicant: HITACHI AUTOMOTIVE SYSTEMS, LTD., Hitachinaka-shi, Ibaraki (JP)

(72) Inventors: Ryo Tadokoro, Atsugi (JP); Shinichi Kawada, Isehara (JP); Atsushi Yamanaka, Atsugi (JP); Hiroyuki Nemoto, Hitachi (JP)

(73) Assignee: HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 0 days.

(21) Appl. No.: 14/178,989

(22) Filed: Feb. 12, 2014

(65) Prior Publication Data

US 2014/0224197 A1 Aug. 14, 2014

(30) Foreign Application Priority Data

Feb. 14, 2013 (JP) ..... 2013-026169

(51) Int. Cl.
*F01L 1/34* (2006.01)
*F01L 1/344* (2006.01)
*F01L 1/053* (2006.01)

(52) U.S. Cl.
CPC ..... *F01L 1/344* (2013.01); *F01L 2001/0537* (2013.01); *F01L 2001/34496* (2013.01); *F01L 2820/032* (2013.01)

(58) Field of Classification Search
CPC ..... F01L 1/344; F01L 2001/0537; F01L 2001/34496; F01L 2820/032
USPC ..... 123/90.11, 90.15, 90.17
See application file for complete search history.

(56) References Cited

U.S. PATENT DOCUMENTS

| | | | | |
|---|---|---|---|---|
| 7,603,223 | B2 | 10/2009 | Moriya | |
| 8,985,075 | B2 * | 3/2015 | Tadokoro et al. | 123/90.17 |
| 2009/0048758 | A1 | 2/2009 | Moriya | |
| 2013/0206087 | A1 | 8/2013 | Tadokoro et al. | |

FOREIGN PATENT DOCUMENTS

| | | | |
|---|---|---|---|
| JP | 2006-207398 | A | 8/2006 |
| JP | 2013-167181 | A | 8/2013 |

* cited by examiner

*Primary Examiner* — Ching Chang
(74) *Attorney, Agent, or Firm* — Foley & Lardner LLP

(57) ABSTRACT

A valve timing control system for an internal combustion engine, comprises: an electric intake valve timing control apparatus to vary an intake valve timing with torque produced by an electric motor with electric power supplied through a power supply mechanism; and an electric exhaust valve timing control apparatus to vary an exhaust valve timing with torque produced by an electric motor with electric power supplied through a power supply mechanism. A heat generating portion in the power supply mechanism of the intake valve timing control apparatus is made of a heat resisting material whereas a heat generating portion in the power supply mechanism of the exhaust valve timing control apparatus is made of a material lower in heat resistance than the heat resisting material of the intake valve timing control apparatus.

5 Claims, 9 Drawing Sheets

VALVE TIMING CONTROL SYSTEM FOR INTERNAL COMBUSTION ENGINE

BACKGROUND OF THE INVENTION

The present invention relates to a valve timing control system for controlling both the intake valve (opening/closing) time and the exhaust valve (opening/closing) timing.

A conventional valve timing control system is arranged to vary the rotational phase of a camshaft relative to a sprocket driven by an engine crankshaft, by the use of hydraulic pressure. Recently, there is provided a valve timing control system arranged to control the valve timings of the intake and exhaust valves by varying the rotational phase of the camshaft relative to the sprocket by transmitting a rotational force of an electric motor through a speed reducer to the camshaft.

In the valve timing control system disclosed in JP 2006-207398A (≈US2009048758A1), there is provided, for each of intake camshaft and exhaust camshaft, a valve timing control mechanism or apparatus driven by an electric motor.

SUMMARY OF THE INVENTION

In the above-mentioned valve timing control system, the intake valve timing control mechanism and exhaust valve timing control mechanism are operated differently. For example, the intake valve timing control mechanism is operated frequently from a start of the internal combustion engine in any engine operating region, whereas the exhaust valve timing control mechanism tends to hold the valve timing (phase) except for a certain engine operating region such as a medium engine speed region.

Therefore, the time of supplying electricity to the electric motor is longer in the intake valve timing control mechanism than in the exhaust valve timing control mechanism. As a result, the amount of heat generated in a electric power supplying mechanism of supplying electric power to the electric motor is greater in the intake valve timing control mechanism or apparatus than in the exhaust valve timing control mechanism or apparatus.

In the valve timing control system as disclosed in the above-mentioned patent document, however, the intake side and the exhaust side are substantially identical in the structure of the power supplying mechanism using the same heat resisting material.

It is, therefore, an object of the present invention to provide a valve timing control system including intake and exhaust valve timing control apparatus which have respective power supplying mechanisms corresponding to respective heat resistance requirements, to reduce an overall cost.

According to one aspect of the present invention, a valve timing control system comprises an electric intake valve timing control apparatus and an electric exhaust valve timing control apparatus each of which includes an electric motor to produce a rotational force with electric power supplied through a power supply mechanism and to vary the intake or exhaust valve timing by utilizing the output torque of the electric motor. A heat generating portion in the power supply mechanism of the electric intake valve timing control apparatus is made of a heat resisting material whereas a heat generating portion in the power supply mechanism of the electric exhaust valve timing control apparatus is made of a material lower in heat resistance than the heat resisting material of the heat generating portion of the power supplying mechanism of the electric intake valve timing control apparatus.

DETAILED DESCRIPTION OF THE INVENTION

First Embodiment

Figure 1:
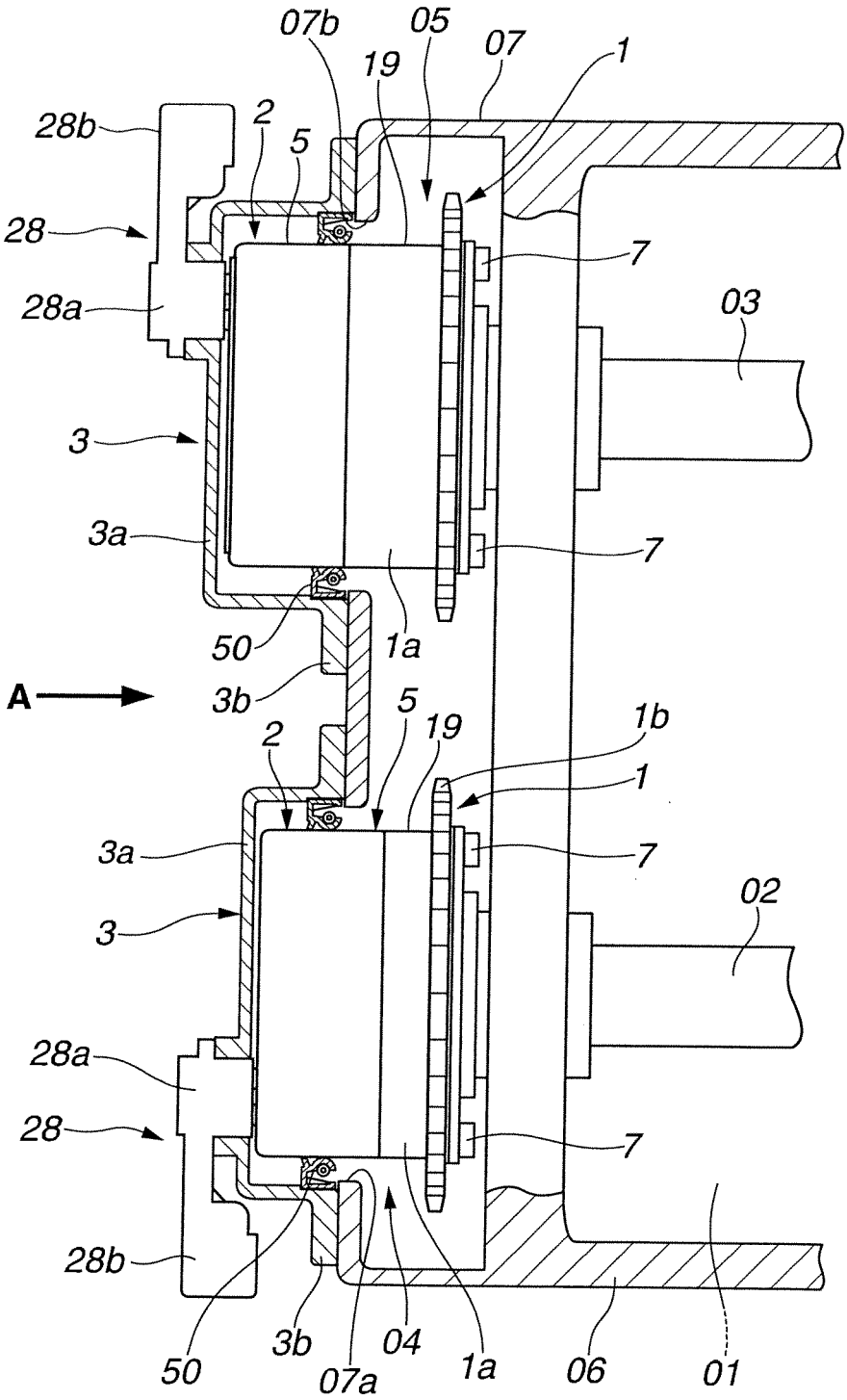
FIG. 1 is a plan view showing a main part of a valve timing control system according to a first embodiment of the present invention.
Figure 2:
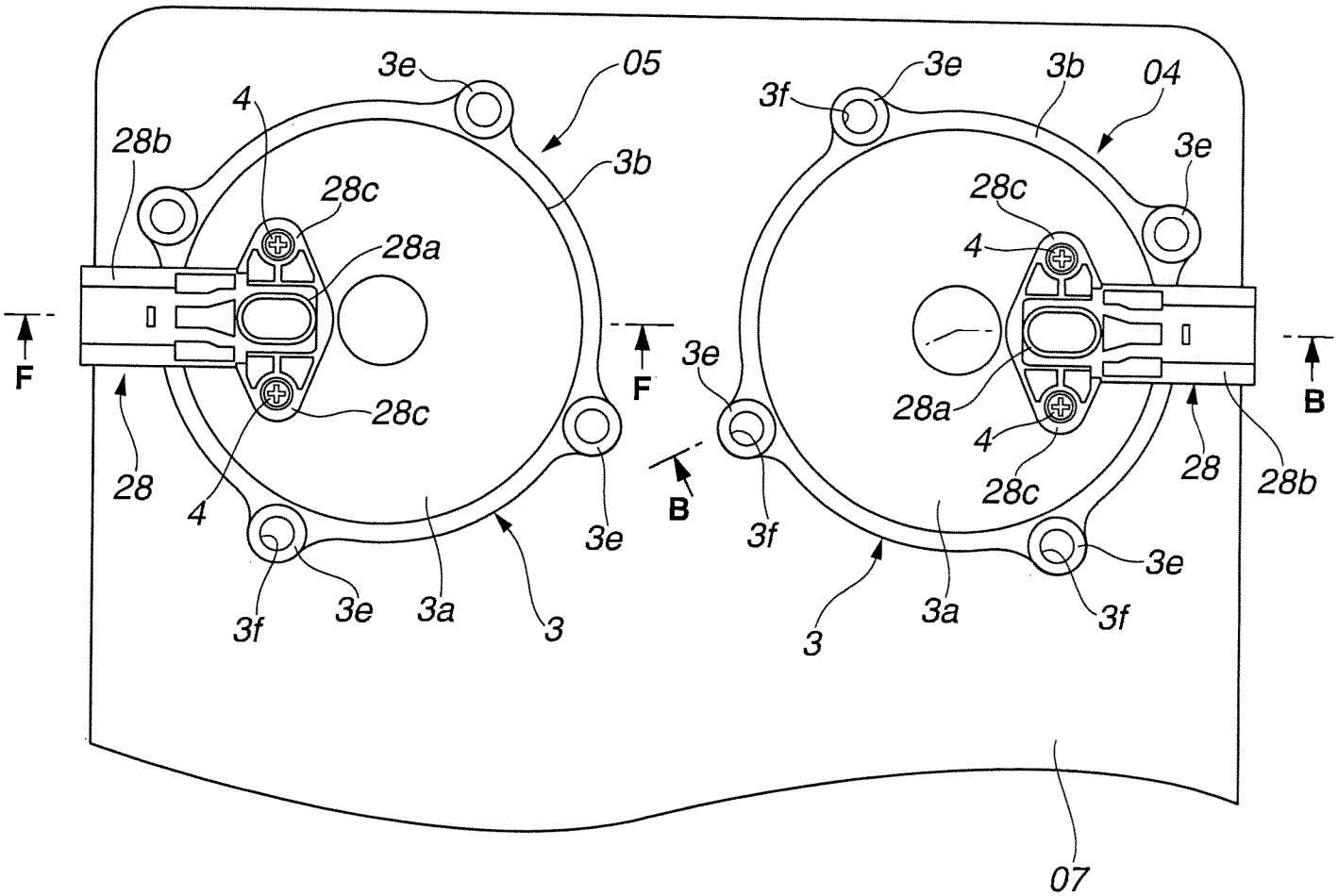
FIG. 2 is a view taken in the direction of an arrow A in FIG. 1.

As shown in FIGS. 1 and 2, there are provided an intake camshaft 02 rotatably supported by a frame-shaped bearing member 06 fixed on an upper deck of a cylinder head 01, and an exhaust camshaft 03 supported rotatably in parallel to intake camshaft 02 by bearing member 06. A valve timing control system includes an electric intake valve timing control apparatus 04 (referred to as intake VTC) provided at a front end portion of intake camshaft 02 and an electric exhaust valve timing control apparatus 05 (referred to as exhaust VTC) provided at a front end portion of exhaust camshaft 03.

The bearing member 06 of this example is made of aluminum alloy and arranged to support the intake and exhaust camshafts 02 and 03 rotatably at front and rear end support points and intermediate support point in a sandwiching state in which the intake or exhaust camshaft is interposed between a half cylindrical bearing groove formed in the upper deck of cylinder head 01 and the bearing member 06 at each of the support points. A chain cover 07 is formed integrally with the bearing member 06, and arranged to cover parts of intake VTC and exhaust VTC 04 and 05. An intake VTC cover 3 is fixed to the front end of chain cover 07 by bolts (not shown) and arranged to cover the front end portion of intake VTC 04. An exhaust VTC cover 3 is fixed to the front end of chain cover 07 by bolts (not shown) and arranged to cover the front end portion of exhaust VTC 05.

Figure 3:
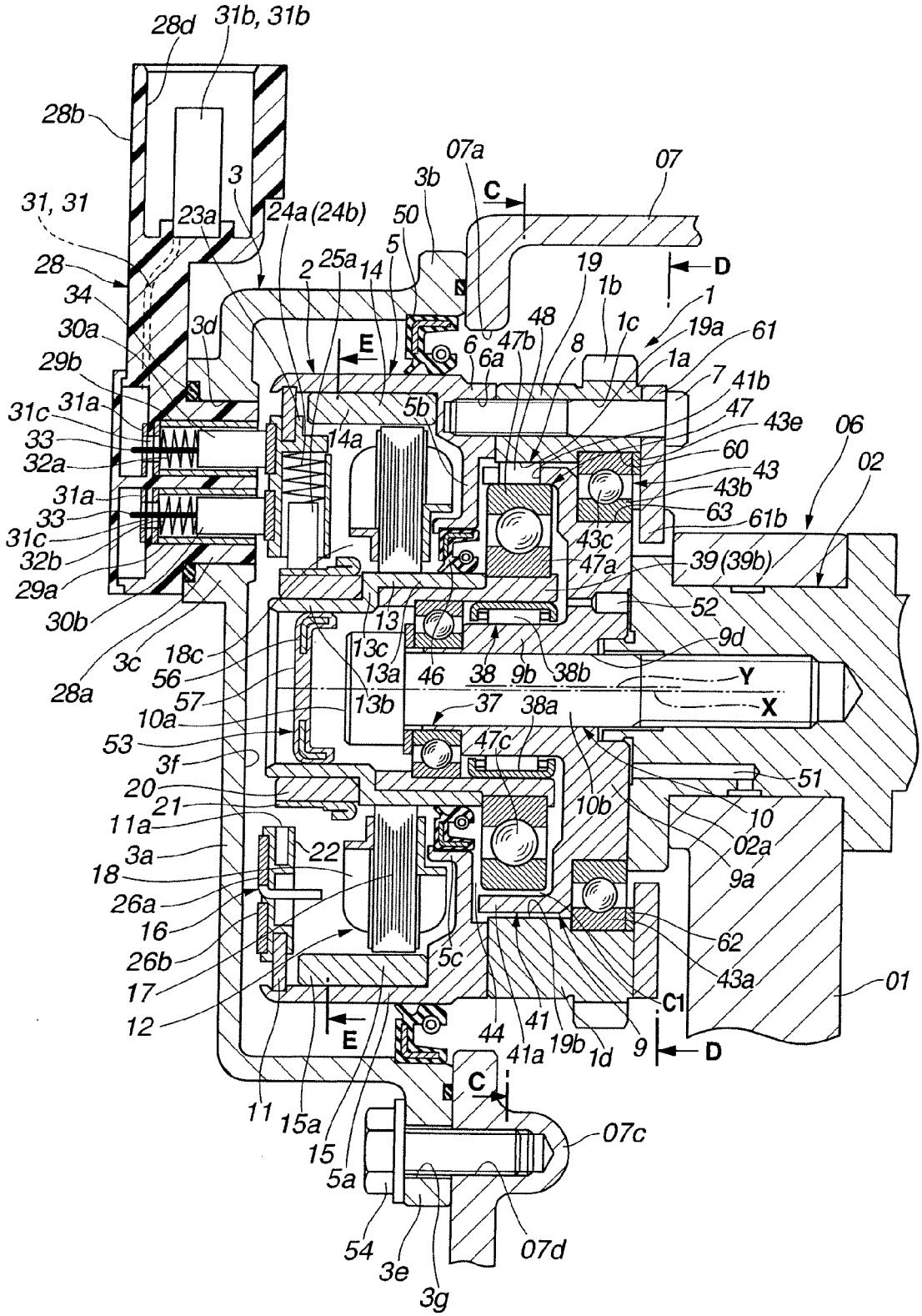
FIG. 3 is a sectional view taken along a line B-B in FIG. 2, for showing an intake VTC 04.
Figure 4:
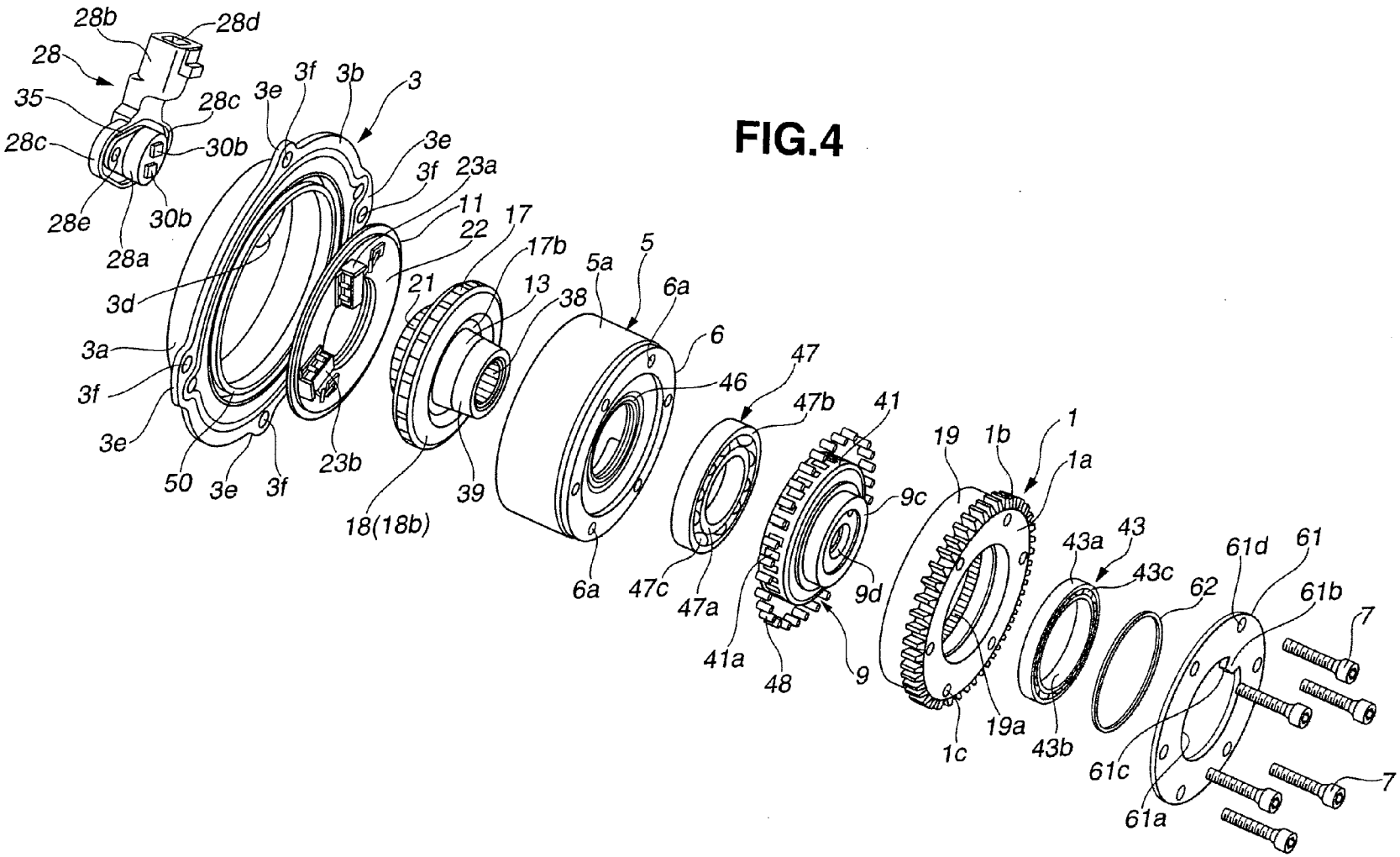
FIG. 4 is an exploded perspective view showing main components of the intake VTC shown in FIG. 3.

Intake VTC 04 includes a sprocket 1 and a phase varying mechanism 2, as shown in FIGS. 3 and 4. Sprocket 1 is a rotating member driven by a crankshaft of the internal combustion engine. Phase varying mechanism 2 is disposed between sprocket 1 and intake camshaft 02, and arranged to vary a relative rotational phase between sprocket 1 and intake camshaft 02, in accordance with engine operating condition or conditions.

Sprocket 1 is an integral cylindrical member made of ferrous metallic material, and sprocket 1 has a hollow cylindrical shape. Sprocket 1 includes a cylindrical main portion or sprocket main portion 1*a*, an external toothed portion 1*b* and an internal toothed portion 19, as shown in FIGS. 3 and 4. The sprocket main portion 1*a* includes a stepped inside circumferential surface. The external toothed portion 1*b* is formed integrally around the sprocket main portion 1*a* and adapted to engage with a timing chain (not shown) and to receive the rotational force from the crankshaft through the timing chain. The internal toothed portion 19 is formed integrally on the front side of sprocket main portion 1*a* so as to project axially to the front side from the sprocket main portion 1*a*.

A large diameter ball bearing 43 supports sprocket 1 rotatably to allow relative rotation between sprocket 1 and intake camshaft 02. The large diameter ball bearing 43 is disposed between the sprocket main portion 1*a* and a follower member 9 provided at the front end portion of intake camshaft 02 as mentioned later.

The large diameter ball bearing 43 includes an outer race 43*a*, an inner race 43*b* and balls 43*c* disposed between outer and inner races 43*a* and 43*b*. Outer race 43*a* is fixed to the inside circumference of sprocket main portion 1*a*. Inner race 43*b* is fixed to the outside circumference of follower member 9.

Cylindrical sprocket main portion 1*a* includes an outer race receiving portion 60 formed in the inside circumference, in the form of an annular groove, and bounded by an annular shoulder surface facing in the rightward direction as viewed in FIG. 3. Outer race 43*a* is inserted axially from the right side as viewed in FIG. 3 until the outer race 43*a* abuts axially on the annular shoulder surface of the outer race receiving portion 60, and thereby forcibly fit in outer race receiving portion 60. The annular shoulder surface of the outer race receiving portion 60 functions to limit the axial movement of outer race 43*a* and thereby to determine the axial position of outer race 43*a*.

The internal toothed portion 19 of sprocket 1 is integral with the sprocket main portion 1*a*, and formed on the front side of sprocket main portion 1*a*. Internal toothed portion 19 in the form of a hollow cylinder projecting axially toward a later-mentioned electric motor 12. Internal toothed portion 19 includes a plurality of teeth 19*a* formed in a wavelike form in the inside circumferential surface of internal toothed portion 19. An annular female screw portion 6 integral with a later-mentioned housing 5 is disposed on the front side of internal toothed portion 19, and the female screw portion 6 confronts the internal toothed portion 19 axially.

An annular holding plate 61 is disposed on the rear side of the sprocket main portion 1*a* of sprocket 1. Therefore, the sprocket main portion 1*a* is located axially between the internal toothed portion 19 on the front side (the left side as viewed in FIG. 3) and the holding plate 61 on the rear side (the right side in FIG. 3). Holding plate 61 is an integral metallic member formed from metal sheet or plate. As shown in FIG. 3, the outside diameter of annular holding plate 61 is approximately equal to the outside diameter of sprocket main portion 1*a*. The inside diameter of annular holding plate 61 is set at such a value that the inside circumference of holding plate 61 is located approximately at a middle between the outside circumference and the inside circumference of larger diameter ball bearing 43.

Therefore, holding plate 61 extends radially inwards beyond the outer race 43*a*, to an inner circumference 61*b* of holding plate 61, and thereby covers the outer race 43 so that holding plate 61 confronts a rear end surface 43*e* of outer race 43 across a predetermined clearance. A stopper projection 61*b* projects radially inwards from the inside circumference 61*a* at a predetermined circumferential or angular position as shown in FIG. 4. The stopper projection 61*b* is an integral part of holding plate 61.

Figure 6:
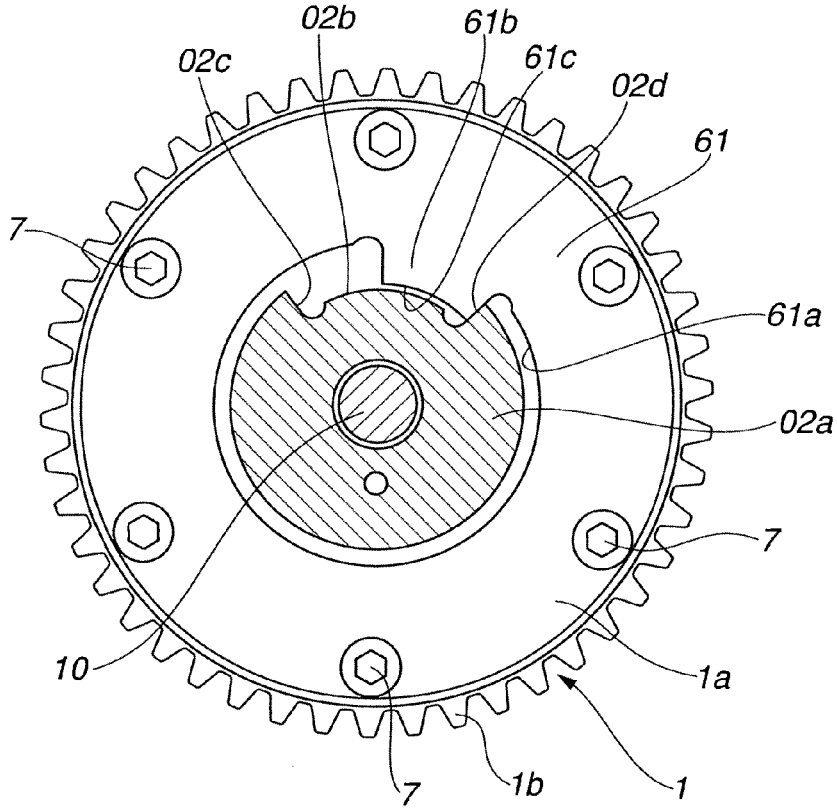
FIG. 6 is a sectional view along a line D-D in FIG. 3.

As shown in FIG. 6, the stopper projection 61*b* of holding plate 61 has a shape like a fan, and projects radially inwards to the inner end 61*c* curved like a circular arc along an arc-shaped bottom surface of a later-mentioned stopper groove 2*b* of intake camshaft 02. In an outer peripheral portion of holding plate 61, there are formed a plurality of bolt holes 61*d* for receiving bolts 7, respectively. In the illustrated example, six of bolt holes 61*d* are opened through holding plate 61 at regular angular intervals in the circumferential direction around the axis.

An annular pressing member 62 is disposed between the inner side (left side) of holding plate 61 and the outer end surface 43*e* of outer race 43*a* of large diameter ball bearing 43 confronting the inner side surface of holding plate 61. This pressing member 62 is designed to impart a slight pressing force from the inner surface of holding plate 61 to the outer end surface 43*e* of outer race 43*a* when the holding plate 61 is fastened by the bolts 7.

The sprocket 1, holding plate 61 and housing 5 are fastened together by the six bolts 7 extending axially. The six bolt through holes 1*c* and 61*d* for the bolts 7 are formed in the outer peripheral portions of sprocket main portion 1*a* (internal toothed portion 19) and holding plate 61 at the regular angular intervals in the circumferential direction. The female screw portion 6 is formed with six female screw thread holes 6*a* at positions corresponding to the positions of bolt through holes 1*c* and 61*d*. Bolts 7 are inserted through the bolt boles 61*d* and 1*c* and screwed into the screw thread holes 6, respectively.

The sprocket main body 1*a*, internal toothed portion 19, holding plate 19, and female screw portion 6 are approximately equal in the outside diameter.

The chain cover 07 is a fixed member extending in the up and down direction as shown in FIGS. 1-3, to cover the timing chain. Chain cover 07 includes a cover wall formed with openings 07*a* and 07*b* at respective positions corresponding to intake VTC 04 and exhaust VTC. A plurality of bosses 07*c* are formed around each of the openings 07*a* and 07*b*. In this example, each opening 07*a* or 07*b* is encircled by four of bosses 07*c* each projecting integrally from the cover wall axially (in the rightward direction in FIG. 3). A female screw hole 07*d* is formed through the cover wall into each of the bosses 07*c*.

The intake VTC cover 3 is an integral cup-shaped member of aluminum alloy, as shown in FIG. 1 and FIG. 3. Intake VTC cover 3 includes a cup-shaped cover main body 3*a* and an annular mounting flange 3*b* formed integrally along the outer peripheral edge of cover main body 3*a*, around the opening end of intake VTC cover 3. The cover main body 3*a* covers the front end portion of the phase varying mechanism 2, and includes a cylindrical wall 3*c* formed integrally at an off center position radially spaced from the axis of intake camshaft 02. Cylindrical wall 3*c* projects axially (in the leftward direction in FIG. 3) and includes a holding hole 3*d* formed therein.

The mounting flange 3*b* is formed with a plurality (four) of bosses 3*e* at regular angular intervals (of about 90 degrees) in the circumferential direction. Each boss 3*e* includes a bolt through hole 3*f* through which a bolt 54 is inserted and tightened into the female screw hole 07*d* of chain cover 07. Thus, intake VTC cover 3 is fastened to chain cover 07 by the bolts 54.

An oil seal 50 having a relatively large diameter is disposed between an inside circumferential surface of an inside stepped annular portion of cover main body 3*a* and the outside circumferential surface of housing 5. Oil seal 50 has a cross section shaped approximately like the letter C. Oil seal 50 is made of synthetic rubber and includes a metallic core embedded in the base material of the synthetic rubber. Oil seal 50 includes an annular outer base portion which is fit and fixed in the inside stepped annular portion of intake VTC cover 3.

The housing 5 includes a housing main member 5*a* and a sealing plate 11, as shown in FIGS. 3 and 4. The housing main member 5*a* is made of a ferrous metallic material and formed into a hollow cylindrical shape having a bottom, by press forming. The sealing plate 11 is arranged to seal a front end opening of housing main member 5*a* and made of nonmagnetic material of synthetic resin.

The housing main member 5*a* includes a bottom wall or end wall 5*b* shaped like a circular disk, facing toward the toothed portion 19 and formed, at or near the center, with a shaft receiving hole receiving a later-mentioned eccentric shaft 39. The shaft receiving hole is a relatively large diameter hole and fringed with a cylindrical projection 5*c* projecting integrally in the axial direction of intake camshaft 02. The female screw portion 6 is formed integrally in the front end peripheral portion of bottom wall 5*b*.

Intake camshaft 02 includes two rotary cams (not shown) for each cylinder, and a flange 02*a*. The rotary cams for each cylinder are formed on the outer circumference of intake camshaft 01, for opening a pair of intake valves. The flange 02*a* is formed integrally at the front end of intake camshaft 02. The follower member 9 is fastened axially in the axial direction to the front end surface of flange 02*a* of intake camshaft 02 by a cam bolt 10. Flange 02*a* of intake camshaft 02 has an outside diameter slightly greater than the outside diameter of a fixing end portion 9*a* of follower member 9, as shown in FIG. 3. After the assemblage of component parts, the outer peripheral portion of the front end surface of flange 02*a* abuts on the end surface of inner race 43*b* of large diameter ball bearing 43.

The stopper groove 02*b* is formed in the circumferential direction in the outside circumference of flange 02*a* of intake camshaft 02, as shown in FIG. 6, and designed to receive the stopper projection 61*b* of holding plate 61. This stopper groove 02*b* extends in the circumferential direction in the form of a circular arc, from a first groove end surface 02*c* to a second groove end surface 02*d* to have a predetermined length. Within the range of this circumferential length, the stopper projection 61*b* can rotate in the stopper groove 02*b*, and abuts against one of first and second groove end surface 02*c* and 02*d* to define the maximum advance relative angular position or the maximum retard relative angular position of intake camshaft 02 relative to the sprocket 1.

The stopper projection 61*b* is spaced axially in the direction toward the intake camshaft 02, from the portion of the holding plate 61 abutting on the outer race 43*a* of ball bearing 43 from the outer side in the axial direction. Therefore, stopper projection 61*b* is spaced axially from the fixing end portion 9*a* of follower member 9, and hence arranged to avoid interference between stopper projection 61*b* and the fixing end portion 9*a*.

The cam bolt 10 includes a head 10*a* and a shank 10*b*, as shown in FIG. 3. An annular washer is mounted on the shank 10*b* and arranged to abut on the head 10*a*. Shank 10*b* includes a male screw portion formed in the outside circumference and designed to screw into a female screw portion formed axially in the intake camshaft 02 from the front end of intake camshaft 02.

The follower member 9 includes the fixing end portion 9*a*, a cylindrical projection or cylindrical portion 9*b* and a holding device or holding portion 41, as shown in FIG. 3. Follower member 9 is an integral member of a ferrous metallic material. The fixing end portion 9*a* is shaped like a circular disk. The cylindrical projection 9*b* projects axially from a central portion of the fixing end portion 9*a* forwards (in the leftward direction in FIG. 3). The holding portion 41 is in the form of a cylindrical wall projecting axially forwards from an outer peripheral portion of the fixing end portion 9*a*, around the cylindrical projection 9*b*. Holding portion 41 is designed to hold a plurality of rollers 48.

The fixing end portion 9*b* of follower member 9 is positioned so that a rear end surface of the fixing end portion 9*b* abuts on a front end surface of the flange 02*a* of intake camshaft 02. The fixing end portion 9*b* is pressed and fixed axially to flange 02*a* of intake camshaft 02 by the axial force of cam bolt 10.

The cylindrical portion 9*b* of follower member 9 includes a center through hole 9*d* opened at the center and arranged to receive the shank 10*b* of cam bolt 10. A needle bearing 38 is provided and mounted on the outer circumferential side of cylindrical portion 9*b*.

Figure 5:
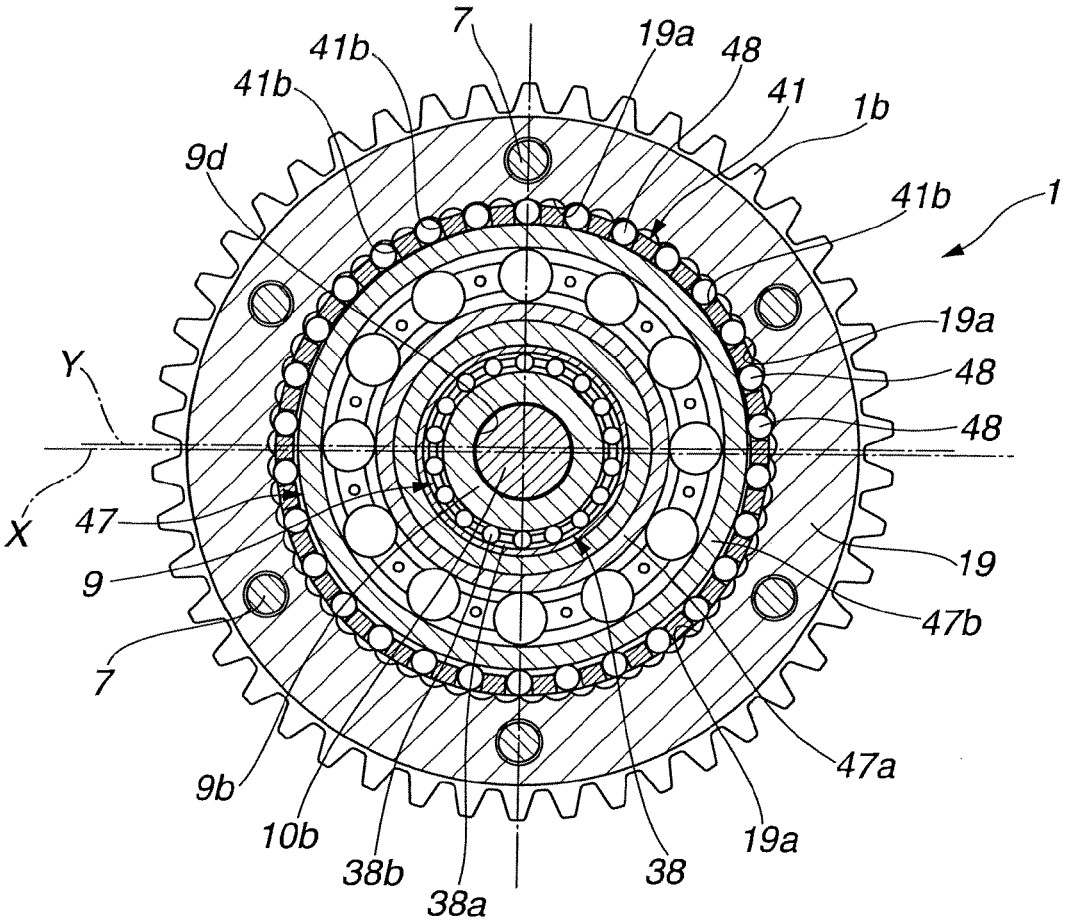
FIG. 5 is a sectional view along a line C-C in FIG. 3.

The holding portion 41 of follower member 9 projects forwards to a front end portion 41*a* from the outer circumference of fixing end portion 9*a* as shown in FIGS. 3-5, around the cylindrical portion 9*b*, and forms a shape like a hollow cylinder having a bottom. The front end portion 41*a* is an annular portion projecting toward the bottom 5*b* of housing 5, through an annular space 44 formed between the female screw portion 6 and the extension portion 5*d*. A plurality of roller holding holes 41*b* are formed in the front end portion 41*a* of holding portion 41 at regular intervals in the circumferential direction so that each hole 41*b* is shaped like a rectangular hole, and designed to hold one of the rollers 48 in a manner allowing rolling motion. The number of the roller holding holes 41*b* (and the number of rollers 48) is smaller by one than the number of the internal teeth 19*a* of internal toothed portion 19.

An inner race mounting portion 63 is formed by cutting in the follower member 9 at a position between the outer circumferential portion of fixing end portion 9*a* and a bottom side connection portion of the holding portion 41, and arranged to fix the inner race 43*b* of larger diameter ball bearing 43.

This inner race mounting portion 63 of follower member 9 includes a cylindrical outside circumferential surface and an annular shoulder surface. The cylindrical outside circumferential surface of inner race mounting portion 63 is depressed radially inwards, positioned to confront radially the outer race mounting portion 60, and extended in the axial direction of intake camshaft 02. The annular shoulder surface of inner race mounting portion 63 is an annular flat surface extending radially and facing axially. The inner race 43*b* of larger diameter ball bearing 43 is fit forcibly over the outside circumferential surface of inner race mounting portion 63 axially, and the inner end surface of inner race 43*b* abuts again the annular shoulder surface of inner race mounting portion 63 to determine the axial position of inner race 43*b*.

The phase varying or altering mechanism 2 includes the electric motor 12 disposed coaxially on the front side of intake cam shaft 02 and a speed reducing mechanism or speed reducer 8 of a roller type in this example, for transmitting rotation of motor 12 at a reduced speed to intake camshaft 02.

Electric motor 12 in this example is a brush DC motor as shown in FIGS. 3 and 4, and includes the housing 5 serving as a yoke rotating as a unit with the sprocket 1, a motor output shaft 13 rotatable in the housing 5, a pair of permanent magnets 14 and 15 of a hemi circular arc shape, fixed, as a stator, to the inside circumference surface of housing 5, and a stationary unit or stator 16 fixed to the seal plate 11.

Motor output shaft 13 is in the form of a stepped cylinder and functions as an armature. Motor output shaft 13 includes a larger diameter portion 13*a*, closer to the intake camshaft 02, a smaller diameter portion 13*b* remoter from intake camshaft 02 and closer to a support member 28, and a step portion 13*c* located about an axial middle of motor output shaft 13, and formed to extend radially and connect the larger diameter portion 13*a* and smaller diameter portion 13*b*. An iron core rotor 17 is fixedly mounted on the larger diameter portion 13*a*. The eccentric shaft 39 is inserted axially and thereby press fit and fixed in the larger diameter portion 13*a*. The inside surface of the step portion 13*c* faces axially toward intake camshaft 02, and abuts against the eccentric shaft 39 to limit the forward axial movement of eccentric shaft 29 and thereby determine the axial position of eccentric shaft 29.

An annular member 20 is fit forcibly over the smaller diameter portion 13*b* of motor output shaft 13. A commutator 21 is fit forcibly over the annular member 20. The outside surface of the step portion 13*c* of motor output shaft 13 faces axially away from intake camshaft 02 and determines the axial position of annular member 20 and commutator 21 by axial abutment against annular member 20.

A plug member 53 is fit forcibly and fixed in the smaller diameter portion 13*b* of motor output shaft 13 to prevent leakage to the outside, of a lubricating oil supplied into motor output shaft 13 and eccentric shaft 39 for lubrication of small diameter ball bearing 37 and needle bearing 38.

The iron core rotor 17 is made of magnetic material, arranged to have a plurality of magnetic poles, and formed as a bobbin having an outer circumference formed with a slot for winding of an electromagnetic coil 18.

The commutator 21 is made of conductive material, and formed to have an annular shape having a plurality of segments so that the number of the segments is equal to the number of the poles of iron core rotor 17. Each segment is electrically connected with an end of a wire taken out from the electromagnetic coil 18. Specifically, the end of the coil wire is tucked into a turn-up portion formed in the inner circumferential side, and thereby connected electrically.

The permanent magnets 14 and 15 are formed as a whole in the form of a hollow cylinder, to have a plurality of magnetic poles in the circumferential direction, and the axial position is offset in the forward direction from the position of the iron core rotor 17.

Figure 7:
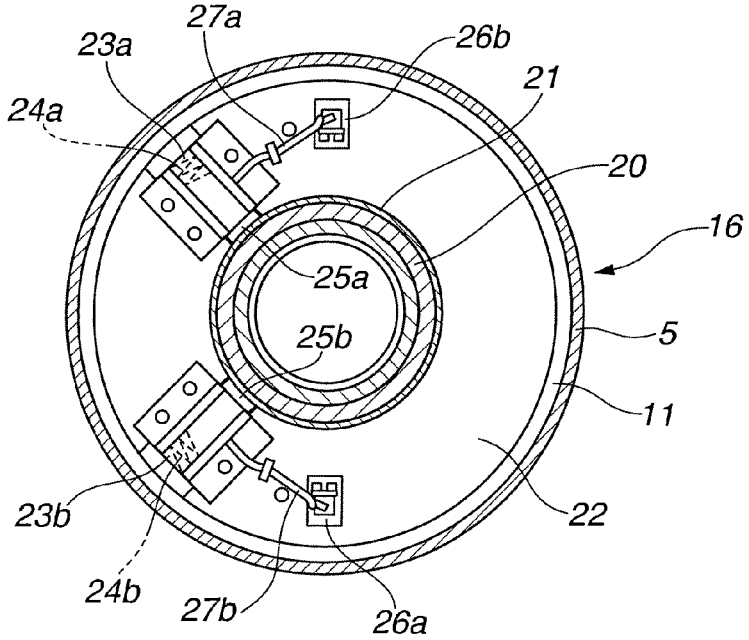
FIG. 7 is a sectional view along a line E-E in FIG. 3.

The stationary unit or stator 16 is a part of an electric power supply mechanism or setup for supplying electric current to the electric motor 12. Stationary unit 16 mainly includes a resin plate 22, a pair of resin holders 23*a* and 23*b*, a pair of first brushes 25*a* and 25*b*, power supplying or feeding slip rings 26*a* and 26*b*, and harnesses 27*a* and 27*b*, as shown in FIG. 7. The resin plate 22 is a plate having a circular disk shape formed integrally with the seal plate 11 on the inner circumferential side. The resin plate 22 can become a heat generating portion (or thermal or exothermic portion or heated portion). The resin holders 23*a* and 23*b* are provided on the inner side of resin plate 11. The resin holders 23*a* and 23*b* become the heat generating portion. The first brushes 25*a* and 25*b* are received, respectively, in the resin holders 23*a* and 23*b* so that first brushes 25*a* and 25*b* can slide radially in resin holders 23*a* and 23*b*, respectively. First brushes 25*a* and 25*b* are urged radially inwards, respectively, by coil springs 24*a* and 24*b* so that the forward ends of first brushes 25*a* and 25*b* abut resiliently on the outside circumferential surface of commutator 21 in the radial direction. The power supplying or feeding slip rings 26*a* and 26*b* are annular members arranged in the form of an annular double structure or concentric structure having an inner portion and an outer portion, and embedded fixedly in the front end surfaces of the resin holders 23*a* and 23*b* in the state in which the outer end surface is bared. The harnesses 27*a* and 27*b* electrically connect the first brushes 25*a* and 25*b* with the power supplying slip rings 26*a* and 26*b*, respectively.

The seal plate 11 is positioned in a stepped recess portion formed in the inside circumference of the front end of housing 5, and fixed by staking or calking. Seal plate 11 includes a center through opening 11*a* through which one end of motor output shaft 13 passes.

The resin plate 22 and resin holders 23*a* and 23*b* are made of a heat resistant synthetic resin material which is a costly polyphenylenesulfide resin (PPS) in this example.

The amount of heat generation is increased at the power supply mechanism or setup to supply electric power to the electric motor 12 on the intake side when the amount of electricity supplied to electric motor 12 is increased to alter the relative rotational phase of intake camshaft 02 relative to sprocket 1 to the advance side or the retard side during operation of the engine in various engine operating regions.

Specifically, heat is generated also by mechanical friction of the forward ends of first brushes 25*a* and 25*b* sliding on the outside circumferential surface of the commutator 21 under the spring forces of coil springs 24*a* and 24*b*, respectively, and the generated heat is conducted to the resin plate 22 and resin holders 23*a* and 23*b*.

Therefore, as the material of resin plate 22 and resin holders 23*a* and 23*b*, this example employs polyphenylenesulfide resin (PPS) which is superior in the heat resistance.

The holder member 28 serving as a holding member is fixed to the cover main body 3*a*. This holder member 28 is a single integral member of a synthetic resin which is an insulating material, formed by molding. Holder member 28 becomes the heat generating portion. Holder member 28 is a part of the electric power supplying mechanism or setup like the stationary unit 16. As shown in FIG. 3, holder member 28 is L-shaped in a side view. As shown in FIGS. 3 and 4, holder member 28 includes a brush holding portion 28*a*, a connector portion 28*b*, bracket portions 28*c*, 28*c*, and a pair of feeding terminal pieces 31, 31. The brush holding portion 28*a* is approximately cylindrical, and adapted to be inserted in the holding hole 3*d* of intake VTC cover 3. The connector portion 28*b* is formed on the upper side of the brush holding portion 28*a*. The bracket portions 28*c*, 28*c* are projections formed on both sides of the brush holding portion 28*a* and fixed to the cover main body 3*a* by bolts. The feeding terminal pieces 31 and 31 are mostly buried in the holding member 28 and arranged to supply electric power.

Terminal pieces 31 are crank-shaped members vertically extending in parallel to each other. Each of terminal pieces 31 includes a first end portion (i.e., a lower end portion) 31*a* bared at the side of a bottom of the brush holding portion 28*a*, and a second end portion (i.e., an upper end portion) 31*b* projecting into a female engaging groove 28*d* of the connector portion 28*b*. The second terminal end portions 31*b* are connected electrically to a control unit through a male connector (not shown).

The brush holding portion 28*a* of holder member 28 extends horizontally (i.e. in the axial direction). Brush holding portion 28*a* has sleeve-shaped slide portions 29*a* and 29*b* which are, respectively, press fit and fixed in cylindrical through holes that horizontally extend in inner and outer positions in brush holding portion 28*a*. Second brushes 30*a* and 30*b* serving as feeding brushes or power supply brushes are supported, respectively, in slide portions 29*a* and 29*b* in such a slideable manner that the second brushes 30*a* and 30*b* can slide axially, and arranged to abut axially on the slip rings 26*a* and 26*b*, respectively, at the forward ends of second brushes 30*a* and 30*b*.

The slide portions 29*a* and 29*b* are made of brass C2600, for example, to secure smooth sliding motion of the second brushes 30*a* and 30*b*.

Each of second brushes 30*a* and 30*b* is shaped like a parallelepiped. Second brushes 30*a* and 30*b* are respectively biased toward the slip rings 26*a* and 26*b* by second coil springs 32*a* such that the projecting forward ends (the rear ends or right ends as viewed in FIG. 3) of second brushes 30*a* and 30*b* abut resiliently on slip rings 26*a* and 26*b*, respectively. Each of second coil springs 32*a* is installed between the base end (or front or left end) of the second brush 30*a* or 30*b* and a bottom plate at a bottom of the corresponding cylindrical through hole.

The base end (left end) of each of second brushes 30*a* and 30*b* is electrically connected with the first (lower) end portion 31*a* of the corresponding terminal piece 31, through a resilient pigtail harness 33 welded therebetween. Each pigtail harness 33 has such a predetermined length as to prevent the second brush 30*a* or 30*b* from falling off from the corresponding slide portion 29*a* or 29*b* when the second brush is urged to advance to a maximum slide position by the coil spring 32*a*, and thereby to determine the maximum forward sliding position of the second brush 30*a* or 30*b*.

An annular seal member 34 is fit in an annular engaging groove formed around the outside circumference of a base portion of the brush holding portion 28*a*.

Each of bracket portions 28*c* is shaped like a triangle as shown in FIG. 2, and formed with a bolt through hole through which a vis 4 is inserted to fasten the bracket 28*c* to the cover main body 3*a*.

The holder member 28 is made of a heat resistant synthetic resin such as polyphenylenesulfide resin (PPS), like the resin plate 22.

The amount of heat generation is increased at the electric power supply mechanism or setup to supply electric power to the electric motor 12 on the intake side when the amount of electricity supplied to electric motor 12 is increased. Specifically, heat is generated also by mechanical friction of the forward ends of second brushes 30*a* and 30*b* sliding on the outside circumferential surface of the slip rings 26*a* and 26*b* under the spring forces of coil springs 32*a* and 32*b*, respectively, and the generated heat is conducted to the holder member 28. Therefore, as the material of holder member 28, this example employs polyphenylenesulfide resin (PPS) which is superior in the heat resistance.

The small diameter ball bearing 37 and needle bearing 38 are arranged to support the motor output shaft 13 and eccentric shaft 39 rotatably. The small diameter ball bearing 37 is provided around the shank 10*b* of cam bolt 10 near the head 10*a*. The needle bearing 38 is provided around the cylindrical portion 9*b* of follower member 9 at the axial position near the small diameter ball bearing 37. The small diameter ball bearing 37 is located axially between the needle bearing 38 and the head 10*a* of cam bolt 10, as shown in FIG. 3.

Needle bearing 38 includes a cylindrical retainer 38*a* press fit in the eccentric shaft 39, and a plurality of needle rollers 38*b* rotatably supported in the retainer 38*a*. The needle rollers 38*a* are rolling elements rolling on the outside circumferential surface of cylindrical portion 9*b* of follower member 9.

The inner race of small diameter ball bearing 37 is fixedly disposed between the front end of cylindrical portion 9*b* of follower member 9 and a washer 10*c* of cam bolt 10.

A smaller diameter oil seal 46 is provided between the outside circumferential surface of motor output shaft 13 (eccentric shaft 39) and the inside circumferential surface of the extension portion 5*d* of housing 5, and arranged to prevent leakage of the lubricating oil from the inside of the speed reducing mechanism 8 into the inside of electric motor 12.

A cap 53 having a U-shaped cross section is press fit and fixed in the front end of motor output shaft 13, as shown in FIG. 3, and arranged to close the inside cavity of motor output shaft 13 receiving the cam bolt 10.

The control unit is configured to determine operating conditions of the engine on the basis of information signals outputted from various sensors (not shown) such as a crank angle sensor, an air flow meter, an engine coolant temperature sensor, an accelerator position or accelerator opening sensor, and to control the engine in accordance with the engine operating conditions. Furthermore, the control unit controls the rotation of motor shaft 13 by energizing the electromagnetic coil 18 and controls the rotational phase of intake camshaft 02 relative to sprocket 1 through speed reducer 8.

The speed reducer or speed reducing mechanism 8 includes mainly, as shown in FIGS. 3-5, the eccentric shaft 39 rotating eccentrically, a medium diameter ball bearing 47 provided around the eccentric shaft 39, the rollers 48 provided around the medium diameter ball bearing 47, the holding portion 41 and the follower member 9 integral with the holding portion 41. The holding portion (or cage) 41 retains rollers 48 so as to enable the rolling motion, and to permits radial displacement of rollers 48.

The eccentric shaft 39 is in the form of a stepped cylinder, and includes a front small diameter portion 39*a* and a rear large diameter portion 39*b*. The front small diameter portion 39*a* is press fit and fixed in the lager diameter portion 13*a* of motor output shaft 13. The rear large diameter portion 39*b* includes an outside circumferential surface formed as a cam surface having an axis Y slightly offset from the axis X of motor output shaft 13 in the radial direction, as shown in FIG. 3.

The medium diameter ball bearing 47 includes an inner race 47*a*, an outer race 47*b* and balls 47*c* disposed between inner and outer races 47*a* and 47*b*. Inner race 47*a* is press fit fixedly over the eccentric shaft 39. On the other hand, outer race 47*b* is held movable in the axial direction. Outer race 47*b* is placed axially between a small clearance on a first axial side or front side and a small clearance on a second axial side or rear side. Therefore, the first axial end of outer race 47*b* facing toward electric motor 12 axially is free without contacting with the adjacent member. The second axial end of outer race 47*b* confronts axially the side surface of holding portion 41 across the small clearance on the second axial side. The rollers 48 are arranged to roll on the outside circumferential surface of outer race 47*b*. There is formed, around the outer race 47*b*, a second clearance C1 as shown in FIG. 3. This second clearance C1 is an annular clearance surrounding the outer race 47*b*. With this annular clearance C1, the medium diameter ball bearing 47 can move radially and hence perform eccentric motion with eccentric rotation of the eccentric shaft 39.

The rollers 48 are made of ferrous metallic material. Each roller 48 moves radially in accordance with the eccentric motion of medium diameter ball bearing 47, and fits in or engages with the internal teeth 19*a* of the internal teeth portion 19 formed as a gear. Respective rollers 48 are also guided, respectively, by both side edges of the roller retaining holes 41*b* in the circumferential direction and swingably moved in the radial direction.

Lubricating oil is supplied to the speed reducer 8 through a lubricating oil supply path or lubricating oil supplying means. The lubricating oil supply path includes an oil supply passage formed in the bearing of the cylinder head and arranged to receive the supply of lubricating oil from an oil gallery (not shown), an oil supply hole 51 extending in intake camshaft 02 in the axial direction of intake camshaft 02, and communicating with the oil supply passage through a groove, a small diameter oil hole 52, and three large diameter oil discharge holes (not shown) extending through the follower member 9. The small-diameter oil hole 52 extends through follower member 9 in the axial direction of follower member 9. Oil hole 52 has one end opened to oil supply hole 51 and the other end opened to the vicinity of needle bearing 38 and medium diameter ball bearing 47.

With the lubricating oil supply path, the lubricating oil is supplied to and stored in the annular space 44, and then supplied to the medium diameter ball bearing 47 and respective rollers 48 for lubrication. The lubricating oil is further conveyed into the eccentric shaft 39 and motor output shaft 13, and supplied to the needle bearing 38 and small diameter ball bearing 37 for lubrication. The lubricating oil stored in annular space 44 is prevented from leaking into housing 5 by the small diameter oil seal 46.

The thus-constructed intake VTC 04 is operated in the following manner. The sprocket 1 is rotated by the rotation of the engine crankshaft through the timing chain. The rotational force of sprocket 1 is transmitted to housing 5 through the internal teeth portion 19 and female screw portion 6, so the electric motor 12 rotates synchronously. On the other hand, the rotational force of internal teeth portion 19 is transmitted to intake camshaft 02 through respective rollers 48, holding portion 41 and follower member 9 so that intake camshaft 02 opens and closes the intake valve(s) with the cam(s) of intake camshaft 02.

The control unit supplies current to electromagnetic coil 18 through terminals 31, 31, the pigtail harnesses 33, 33, feeding brushes 30*a*, 30*b* and slip rings 26*a*, 26*b* at the time of predetermined engine operation. Therefore, the motor output shaft 13 is rotated, and the rotational force is transmitted, through speed reducer 8, at a reduced speed to intake camshaft 02.

Specifically, when eccentric cam 39 is rotated eccentrically with the rotation of motor shaft 13, each of the rollers 48 moves from one of the internal teeth 19*a* of internal gear portion 19 to the next one of the teeth 19*a* with rolling motion while being guided in one of the roller retaining holes 41*b* of holding portion 41 in the radial direction for each of revolutions of motor shaft 13. Respective rollers 48 move in the circumferential direction by repeating such rolling movement. Owing to the rolling movement of rollers 48, the rotation of motor output shaft 13 is transmitted at the reduced speed to follower member 9. It is possible to set the speed reduction ratio optionally by the number of rollers 48.

Thus, the intake VTC 04 can alter the rotational phase of intake camshaft 02 relative to sprocket 1 by rotating intake camshaft 02 relative to sprocket 1, and thereby control the intake opening timing and the intake vale closing timing to the advance side or the retard side.

The rotational speed of electric motor 12 is reduced by utilizing the rolling motion of the rollers 48 arranged in the internal teeth 19*a*. This arrangement can reduce the friction sufficiently at the time of speed reduction, and thereby improve the response characteristic of the relative rotation alteration of intake camshaft 02 relative to sprocket 1 in the advance or retard direction.

[Exhaust VTC]

Figure 8:
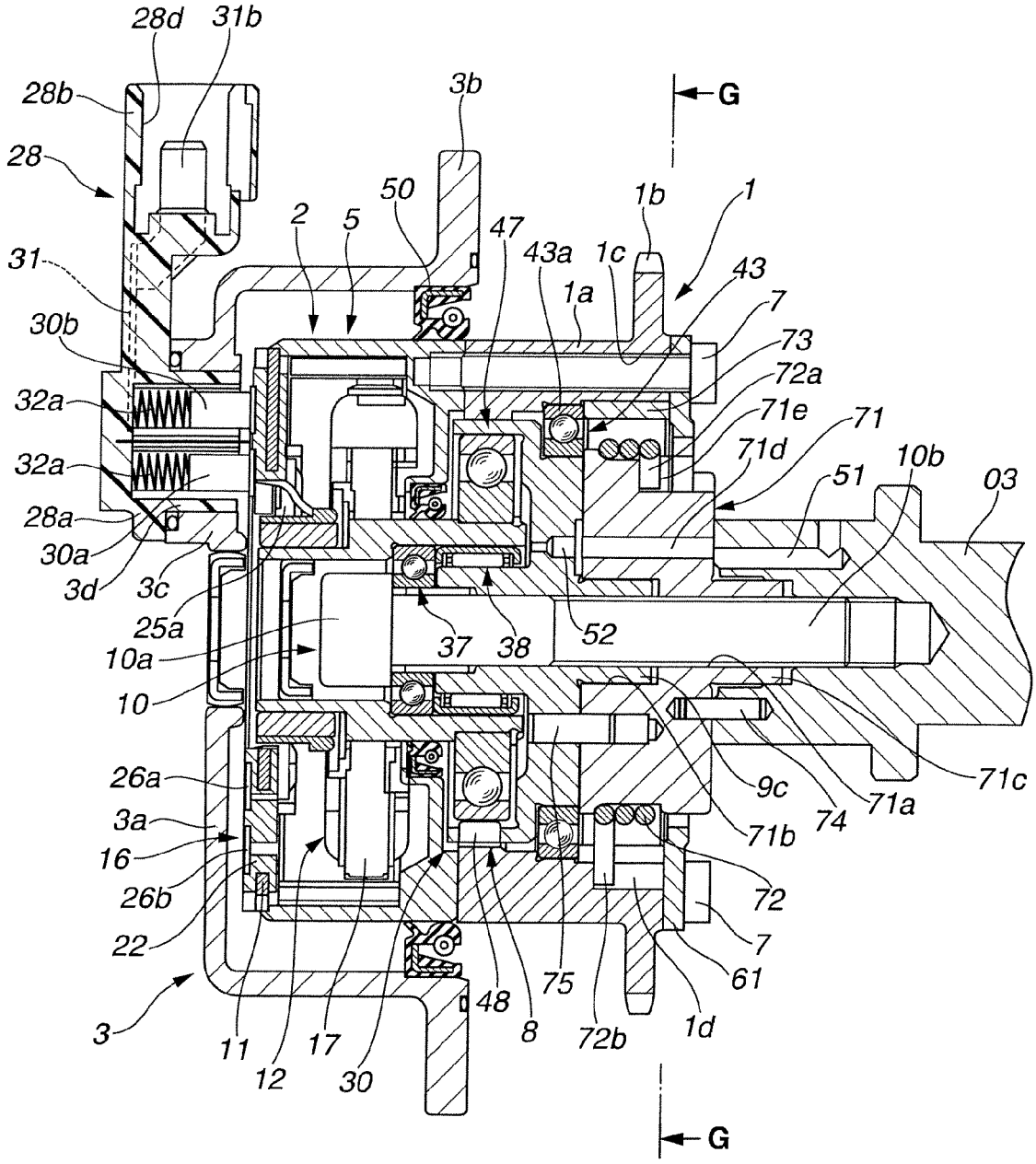
FIG. 8 is a sectional view along a line F-F in FIG. 2, for showing an exhaust VTC 05.
Figure 9:
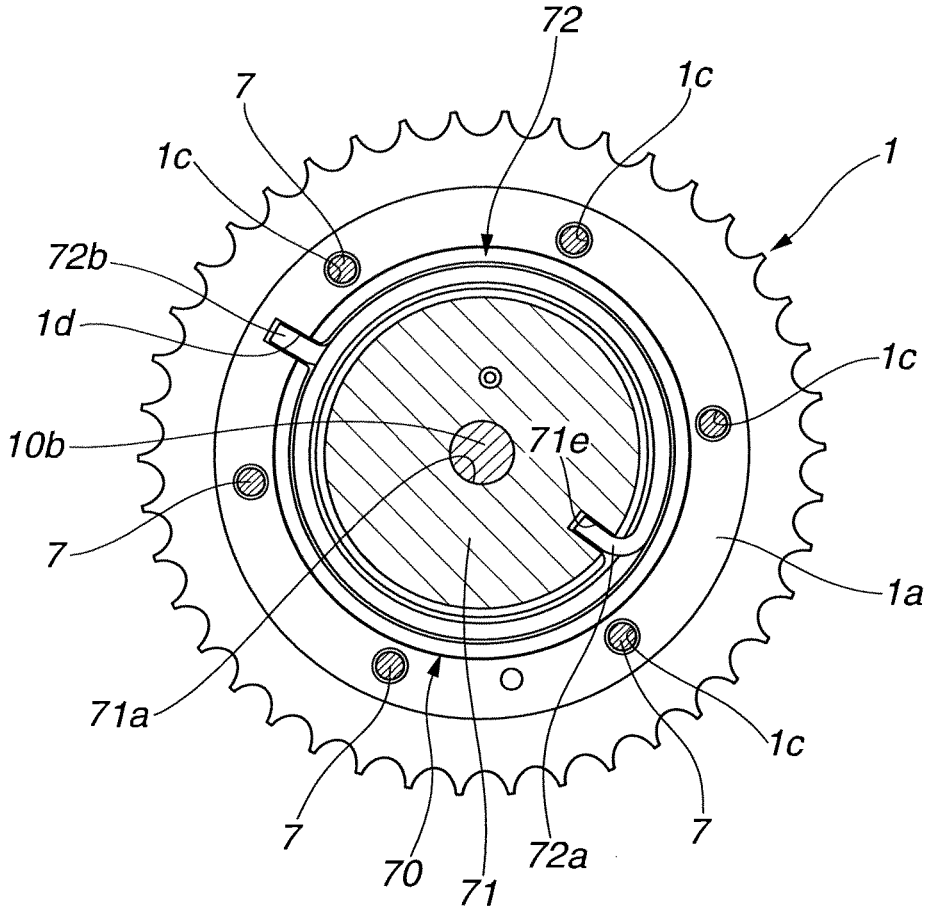
FIG. 9 is a sectional view along a line G-G in FIG. 8.

The electric exhaust VTC 05 is substantially identical in the basic construction to the electric intake VTC 04, as shown in FIGS. 1, 8 and 9. Accordingly, identical parts are given the same reference numerals and detailed explanation is omitted.

The exhaust VTC 05 is different from intake VTC 04 in that there is provided an urging mechanism 70, and the material of member of electric power supply mechanism such as resin plate 22 of stationary unit 16, resin holders 23*a*, 23*b* and holder member 28 is changed. The urging mechanism 70 is provided between exhaust camshaft 03 and follower member 9, and arranged to urge the exhaust camshaft 03 to the advance side relative to sprocket 1.

Exhaust VTC 05 includes a sprocket 1 and a phase varying mechanism 2, as shown in FIG. 8. Sprocket 1 is a rotating member driven by the crankshaft of the internal combustion engine. Phase varying mechanism 2 is disposed between sprocket 1 and exhaust camshaft 03, and arranged to vary the relative rotational phase between sprocket 1 and exhaust camshaft 03, in accordance with engine operating condition or conditions.

Sprocket 1 is an integral cylindrical member made of ferrous metallic material, and sprocket 1 has a hollow cylindrical shape. Sprocket 1 includes a cylindrical sprocket main portion 1*a*, an external toothed portion 1*b* and an internal toothed portion 19. The external toothed portion 1*b* is formed integrally around the sprocket main portion 1*a* and adapted to engage with a timing chain (not shown) and to receive the rotational force from the crankshaft through the timing chain. The internal toothed portion 19 is formed integrally on the front side of sprocket main portion 1*a* so as to project axially to the front side from the sprocket main portion 1*a*.

The sprocket main body 1*a* extends longer, toward the internal teeth portion 19, than that of the intake VTC 04.

The urging mechanism 70 includes a spring retainer 71 and a torsion spring 72. The spring retainer 71 is disposed between the front end of exhaust camshaft 03 and the fixing end portion 9*a* of follower member 9 and fastened together by the cam bolt 10. The torsion spring 72 is disposed around the spring retainer 71.

The spring retainer 71 is shaped like a cylinder having a relatively short axial length. Spring retainer 71 includes a bolt through hole 71*a*, a fitting hole 71*b* and a cylindrical projection 71*c*. The bolt through hole 71*a* is opened axially through spring retainer 71 at the center and arranged to receive cam bolt 10 extending through the bolt through hole 71*a*. The fitting hole 71*b* is formed in the front side of spring retainer 71 (the left side as viewed in FIG. 8) at the center and shaped to fittingly receive the cylindrical projection 9*c* of follower member 9 projecting rearwards toward exhaust camshaft 03. The cylindrical projection 71*c* projects rearwards (to the right in FIG. 8) at the center, into a fitting hole 03*a* formed at the center of the front end of exhaust camshaft 03. Cylindrical projection 71*c* is an integral portion of spring retainer 71.

Spring retainer 71 is further formed with a communication hole 71*d* extending axially through spring retainer 71 and connecting an oil hole 51 formed in exhaust camshaft 03, and an oil hole 52 formed in follower member 9, and a first engagement groove 71*e* formed in the outside circumference of spring retainer 71 at the rear (right) end on the rear side or exhaust camshaft's side, and arranged to retain a first end portion 72*a* of the torsion spring 72 radially. The first engagement groove 71*e* is in the form of a slit extending axially.

The torsion spring 72 is disposed resiliently around the spring retainer 71 as shown in FIG. 9. Torsion spring 72 extends from the first end portion 72*a* to a second end portion 72*b*. The first end portion 72*a* is bent radially inwards and inserted in the first engagement groove 71*e* of spring retainer 71, radially. The second end portion 72*b* is bent radially outwards and inserted radially in a second engagement groove 1*d* formed in the form of a slit, in the inside circumference of gear portion 1*b* of the sprocket main body 1*a*.

Thus, the torsion spring 72 always urges the exhaust camshaft 03 in the rotational direction as shown by an arrow in FIG. 9 to the advance side, relative to sprocket 1. Therefore, this valve timing control system can eliminate the valve overlap between the exhaust valve and the intake vale at the time of engine start, and thereby improve the combustion quality and the engine starting performance.

A tubular pushing member 73 is disposed in the inside circumference of sprocket main body 1*a* and arranged to axially push and support the outer race 43*a* of large diameter ball bearing 43, through holding plate 61, with the axial force of each bolt 7.

A locate pin 74 is forcibly fit in the axial direction in exhaust camshaft 03 and spring retainer 71 to determine the radial position relative to each other. Similarly, a locate pin 75 is forcibly fit in the axial direction in spring retainer 71 and follower member 9 to determine the radial position relative to each other.

The thus-constructed exhaust valve timing control apparatus 05 need not alter the relative rotational phase of exhaust camshaft 03 relative to sprocket 1 so frequently during engine operation. At the time of engine start, and in the high speed, high load operation, the relative rotational phase is forcibly shifted to the advance side by the resilient force of the torsion spring 72 without driving electric motor 12. During the steady state engine operation, the relative rotational phase is normally held at the intermediate phase position. Therefore, the amount of supply of electric power to the electric motor 12 on the exhaust side is smaller than the intake side, so that the amount of heat generation is lower on the exhaust side.

The amount of heat generated in the electric power supplying mechanism for electric motor 12 is relative small on the exhaust side and the requirement for the heat resistance is relatively low on the exhaust side. Therefore, as the material of the heated portion of the stationary unit 16 constituting the electric power supplying mechanism including the resin plate 22, resin holders 23*a*, 23*b* and holding member 28 on the exhaust side, this embodiment employs nylon resin material which is sufficiently inexpensive as compared to the polyphenylene sulfide resin (PPS) employed on the intake side.

In the first embodiment, polyphenylenesulfide (PPS) is employed as the material of the resin plate 22, resin holders 23*a* and 23*b* and holding member 28 in the electric power supply mechanism on the intake side, and nylon resin is employed as the material of the resin plate 22, resin holders 23*a* and 23*b* and holding member 28 in the electric power supply mechanism on the exhaust side. Therefore, it is possible to reduce the manufacturing cost especially the manufacturing cost of the exhaust valve timing control apparatus 05.

Second Embodiment

Figure 10:
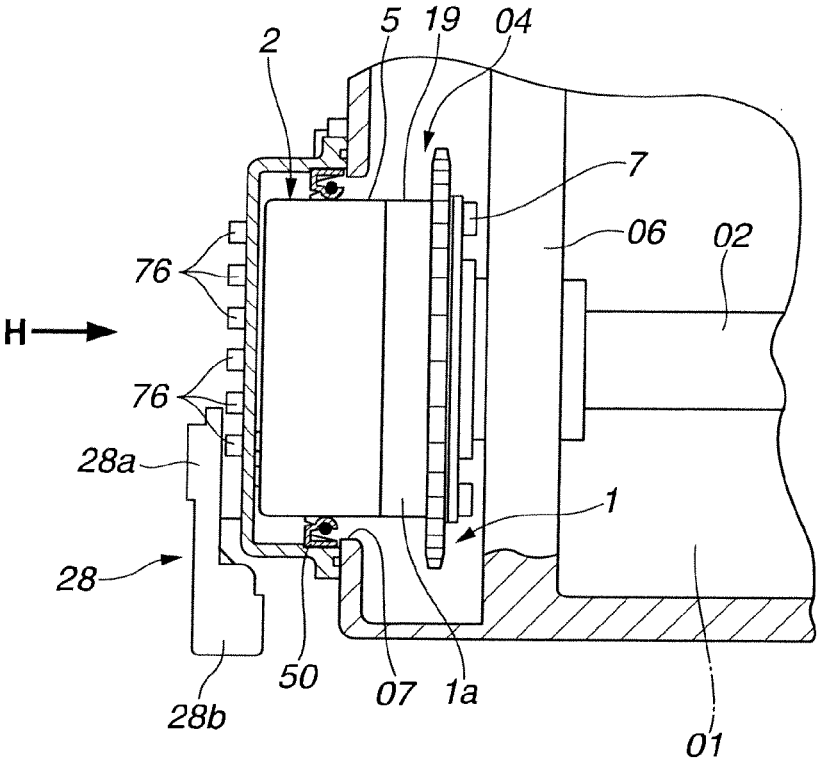
FIG. 10 is a plan view showing an intake VTC in a valve timing control system according to a second embodiment of the present invention.
Figure 11:
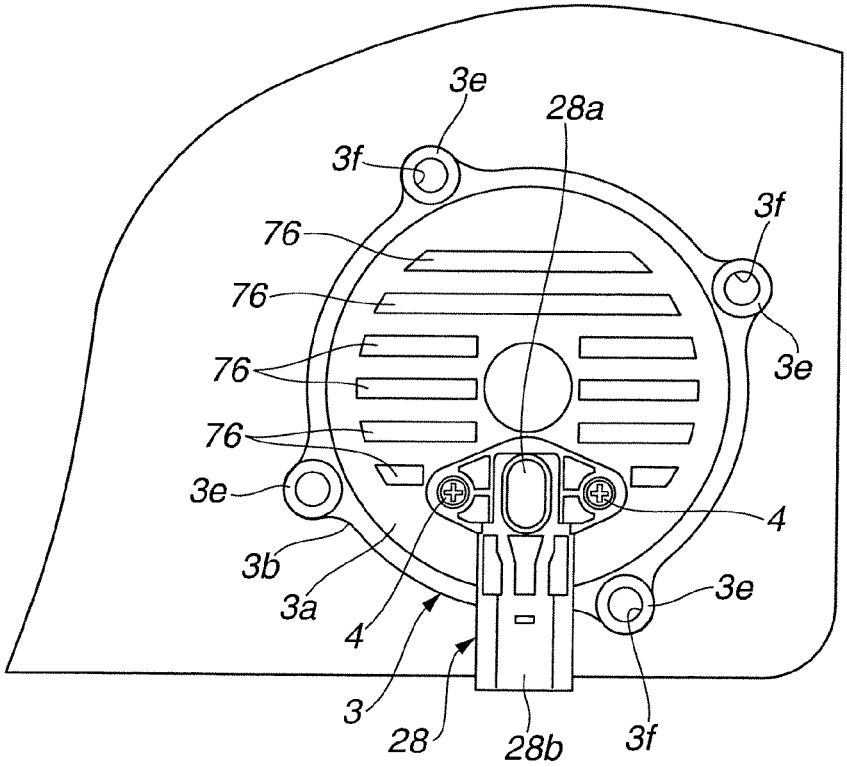
FIG. 11 is a view taken in the direction of an arrow H in FIG. 10.

FIGS. 10 and 11 show a valve timing control system according to a second embodiment of the present invention. In the second embodiment, there are provided a plurality of radiating of cooling fins 76 formed in the outside surface of intake VTC cover 3 of intake valve timing control apparatus 04. The basic constructions and the materials of the resin parts of the electric power supply mechanisms on the intake and exhaust sides are the same as those of the intake valve timing control apparatus 04 and exhaust valve timing control apparatus 05 according to the first embodiment.

The intake VTC cover 3 is a single integral member of an aluminum alloy, includes the cover main body 3*a* including a flat outside surface formed integrally with the radiating fins 76. Fins 76 extend laterally and are arranged vertically, as shown in FIGS. 10 and 11. By contrast, the exhaust VTC cover 3 of the exhaust valve timing control apparatus 05 is formed with no fins. Fins 76 are formed only on the intake VTC cover 3.

Therefore, in the valve timing control system according to the second embodiment, heat transferred from the first brushes 30*a* and 30*b* on the intake side to the holding member 28 is dissipated from the intake VTC cover 3 through the radiating or cooling fins 76 to the surrounding air, and hence the holding member 28 is cooled effectively.

Consequently, it is possible to employ the uncostly nylon resin instead of the polyphenylene sulfide resin, as the material of the holding member 28 on the intake side, and thereby to reduce the overall cost of the valve timing control system.

According to the illustrated embodiments of the present invention, a valve timing control system or apparatus for an internal combustion engine comprises an electric intake valve timing control section provided for an intake camshaft, and arranged to vary an intake valve timing with an output torque of an electric motor; and an electric exhaust valve timing control section provided for an exhaust camshaft, and arranged to vary an exhaust valve timing with an output torque of an electric motor.

Each of the intake and exhaust valve timing control sections includes a brush holding member holding a brush of the electric motor which is a brush motor.

The brush holding member of the intake valve timing control section is made of a first insulating material and the brush holding member of the exhaust valve timing control section is made of a second insulating material which is lower in heat resistance than the first insulating material.

This application is based on a prior Japanese Patent Application No. 2013-26169 filed on Feb. 14, 2013. The entire contents of this Japanese Patent Application are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control system for an internal combustion engine, comprising:

an electric intake valve timing control apparatus provided for an intake camshaft, and arranged to vary an intake valve timing with an output torque of an electric motor which is included in the intake valve timing control apparatus, and which is constructed to produce a rotational force with electric power supplied through a power supply mechanism; and an electric exhaust valve timing control apparatus provided for an exhaust camshaft, and arranged to vary an exhaust valve timing with an output torque of an electric motor which is included in the exhaust valve timing control apparatus and which is constructed to produce a rotational force with electric power supplied through a power supply mechanism;

a heat generating portion in the power supply mechanism of the electric intake valve timing control apparatus being made of a heat resisting material whereas a heat generating portion in the power supply mechanism of the electric exhaust valve timing control apparatus is made of a material lower in heat resistance than the heat resisting material of the heat generating portion of the power supplying mechanism of the electric intake valve timing control apparatus.

2. A valve timing control system for an internal combustion engine, comprising:

an electric intake valve timing control apparatus provided for an intake camshaft, and arranged to vary an intake valve timing with a rotational force produced with electric power supplied through a slip ring and a feeding brush abutting on the slip ring; and an electric exhaust valve timing control apparatus provided for an exhaust camshaft, and arranged to vary an exhaust valve timing with a rotational force produced with electric power supplied through a slip ring and a feeding brush abutting on the slip ring;

an intake side holding member holding the feeding brush of the electric intake valve timing control apparatus being made of an insulating material having a heat resistance higher than a heat resistance of an insulating material of an exhaust side holding member holding the feeding brush of the electric exhaust valve timing control apparatus.

3. The valve timing control system as claimed in claim 2, wherein the insulating material of the intake side holding member is polyphenylene sulfide resin, and the insulating material of the exhaust side holding member is one of phenol resin and nylon resin.

4. A valve timing control system for an internal combustion engine, comprising:

an electric intake valve timing control apparatus provided for an intake camshaft, the electric intake valve timing control apparatus including an electric motor to produce a rotational force with electric power and a speed reducing mechanism to reduce a speed of rotation of the electric motor and to vary an intake valve timing; and an electric exhaust valve timing control apparatus provided for an exhaust camshaft, the electric exhaust valve timing control apparatus including an electric motor to produce a rotational force with electric power and a speed reducing mechanism to reduce a speed of rotation of the electric motor and to vary an exhaust valve timing;

the electric intake valve timing control apparatus including a heat generating portion which receives heat generated by supply of the electric power to the electric motor and which is constructed to have a structure high in heat dissipation in comparison with a heat generating portion of the electric exhaust valve timing control apparatus.

5. The valve timing control system as claimed in claim 4, wherein the heat generating portion of the electric intake valve timing control apparatus is provided with a heat dissipating fin.

* * * * *